US005495260A

United States Patent [19]

Couture

[11] Patent Number: 5,495,260

[45] Date of Patent: Feb. 27, 1996

[54] PRINTED CIRCUIT DIPOLE ANTENNA

[75] Inventor: Tammy E. Couture, Hollywood, Fla.

[73] Assignee: Motorola, Inc., Schaumburg, Ill.

[21] Appl. No.: 405,430

[22] Filed: Mar. 16, 1995

Related U.S. Application Data

[63] Continuation of Ser. No. 103,657, Aug. 9, 1993, abandoned.

[51] Int. Cl.[6] ..... H01Q 1/38

[52] U.S. Cl. ..... 343/795; 343/700 MS; 343/702

[58] Field of Search ..... 343/700 MS, 702, 343/795, 741, 742, 705, 803

[56] References Cited

U.S. PATENT DOCUMENTS

| | | | |
|---|---|---|---|
| 4,700,194 | 10/1987 | Ogawa et al. | 343/700 MS |
| 4,719,470 | 1/1988 | Munson | 343/700 MS |
| 4,721,962 | 1/1988 | Gorzel | 343/702 |
| 4,758,843 | 7/1988 | Agrawal et al. | 343/795 X |
| 4,860,019 | 8/1989 | Jiang et al. | 343/795 |
| 5,087,922 | 2/1992 | Tang et al. . | |
| 5,206,655 | 4/1993 | Caille et al. . | |
| 5,206,657 | 4/1993 | Downey . | |
| 5,229,782 | 7/1993 | Hemmie et al. | 343/795 |
| 5,231,407 | 7/1993 | McGirr et al. | 343/702 |
| 5,293,176 | 3/1994 | Elliot | 343/797 |

*Primary Examiner*—Donald T. Hajec
*Assistant Examiner*—Tho Phan
*Attorney, Agent, or Firm*—Kelly A. Gardner

[57] ABSTRACT

A paging receiver (100) comprises a printed circuit board (200) on which receiving circuitry (110) is mounted. The printed circuit board (200) comprises a plurality of conductive runners (205, 210, 305, 310) which form a dipole antenna (105) for providing radio frequency signals to the receiving circuitry (110). First and second elongated runners (205, 210) are plated on a first surface (215) of the printed circuit board (200) along a single axis. Third and fourth elongated runners (305, 310) are plated on a second surface (300) of the printed circuit board (200) parallel to and beneath the first and second elongated runners (205, 210), respectively. The first and third runners (205, 305) are electrically coupled via a first plated hole (230) to form a first monopole element of the dipole antenna (105) for providing the signals to the receiving circuitry (110), and the second and fourth runners (210, 310) are electrically coupled via a second plated hole (240) to form a second monopole element of the dipole antenna (105).

15 Claims, 2 Drawing Sheets

PRINTED CIRCUIT DIPOLE ANTENNA

This is a continuation of application Ser. No. 08/103,657, filed Aug. 9, 1993, now abandoned.

FIELD OF THE INVENTION

This invention relates in general to antennas for receiving radio frequency signals, and more specifically to an antenna which is designed onto a printed circuit board.

BACKGROUND OF THE INVENTION

Conventional paging receivers utilize many types of antennas for receiving signals having specific frequencies. Typically, antenna size and shape varies with both the frequency of the signals the antenna is to receive and the size and shape of the paging receiver which houses the antenna. For instance, in many low frequency applications, the antenna takes the form of a wire connected to the receiver. In VHF and UHF bands, antennas are often shaped such that a loop antenna or a dipole antenna is formed. In each case, however, the antenna must not only function electrically, but also physically fit into the paging receiver.

As technology has advanced, a greater number of features has been included in paging receivers due to customer demand. Many of these features, such as alphanumeric displays, real time clocks and alarms, musical alerts, etc., require a large amount of complex circuitry for implementation, which tends to increase the size of a paging receiver including such features. At the same time, however, market trends have dictated that paging receivers become smaller and lighter such that a user can easily carry a paging receiver without strain or discomfort. These conflicting requirements have necessarily resulted in paging receivers in which the space available for accommodating an antenna has decreased. One solution to this problem is to reduce the size of the antenna. This cannot always be done, however, without adversely affecting the electrical performance of the radio receiver.

Thus, what is needed is an antenna which can be accommodated in a limited amount of space without adversely affecting the performance of a radio receiver housing the antenna.

SUMMARY OF THE INVENTION

A radio receiver for receiving radio frequency (RF) signals comprises an insulative substrate on which receiving circuitry for recovering information included in the RF signals is mounted and a dipole antenna for receiving the RF signals. The dipole antenna includes a first elongated member plated on a first surface of the insulative substrate along a single axis and coupled to the receiving circuitry for providing the RF signals thereto, and a second elongated member plated on a second surface of the insulative substrate opposite the first surface. The second elongated member is formed approximately parallel to and beneath the first elongated member and coupled thereto by a plated hole formed through the insulative substrate at outer regions of the first and second elongated members, thereby forming a first monopole element. A third elongated member is plated on the first surface of the insulative substrate along the single axis and coupled to a ground terminal on the first surface of the substrate for receiving a ground voltage. A fourth elongated member is plated on the second surface of the insulative substrate and formed approximately parallel to and beneath the third elongated member and coupled to the third elongated member, thereby forming a second monopole element.

DESCRIPTION OF A PREFERRED EMBODIMENT

Figure 1:
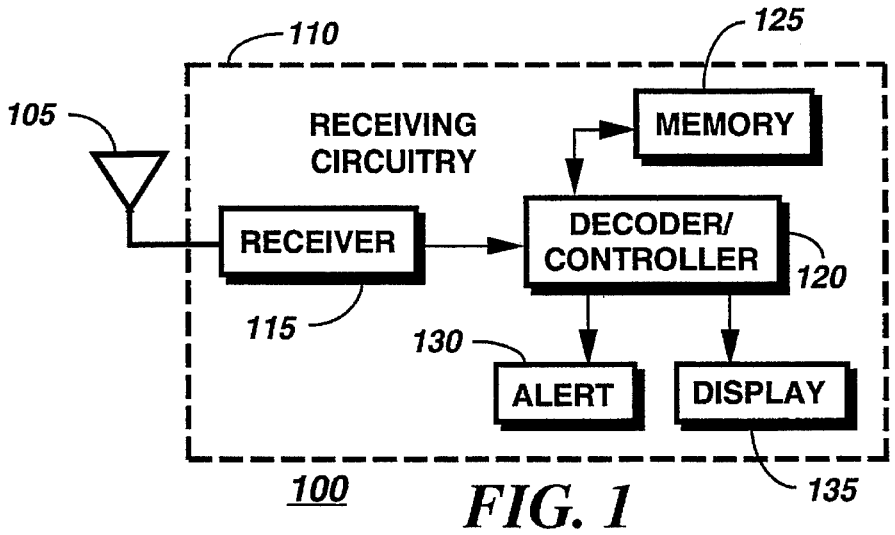
FIG. 1 is an electrical block diagram of a radio receiver including an antenna configured in accordance with a preferred embodiment of the present invention.

FIG. 1 is an electrical block diagram of a radio receiver 100 for receiving radio frequency (RF) signals. The radio receiver 100 comprises a dipole antenna 105 configured for receiving a predetermined range of frequencies and coupled to receiving circuitry 110 for processing the RF signals provided thereto by the antenna 105. When the radio receiver 100 is a paging receiver, the receiving circuitry 110 typically comprises a receiver 115 for demodulating a received RF signal and a decoder/controller 120 coupled to the receiver 115 for recovering from the RF signal a selective call message, which may be subsequently stored in a memory 125. The receiving circuitry 110 can further comprise an alert mechanism 130 for emitting an audible tone in response to reception of the selective call message and a display 135 for displaying the selective call message to a user.

Figure 2:
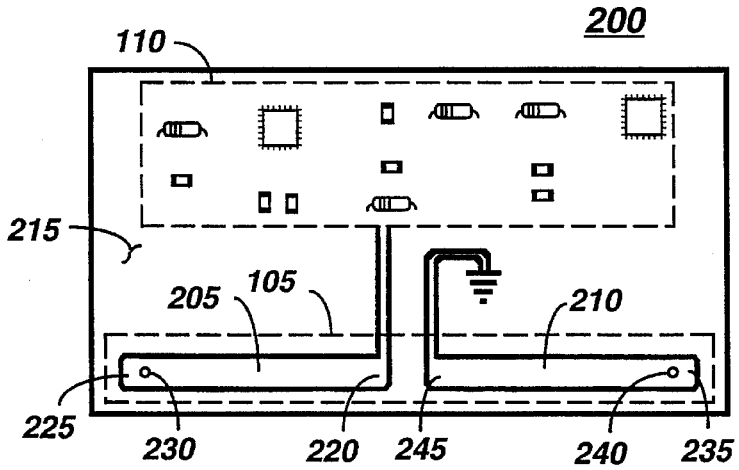
FIG. 2 is an orthographic view of a first surface of a substrate and circuitry, including the antenna, included in the radio receiver of FIG. 1 in accordance with the preferred embodiment of the present invention.

FIG. 2 is an orthographic view of a first surface 215 of an insulative substrate 200, such as a printed circuit board, included within the radio receiver 100 (FIG. 1). In accordance with the present invention, two elongated runners 205, 210 formed along a single axis, as shown, partially comprise the dipole antenna 105. The two runners 205, 210, which may be formed from copper, for example, are preferably plated onto the first surface 215 of the substrate 200 in a manner well known to one of ordinary skill in the art. The size, i.e., length and width, of the two runners 205, 210 is dependent upon the frequency at which the RF signals are received, the dielectric constant of the substrate 200, and the thickness of the substrate 200.

At an inner end 220, the first runner 205 is electrically coupled, such as by wiring or printed circuit board runners, to the receiving circuitry 110 which is mounted to the substrate 200. At an outer end 225, the first runner is electrically coupled, preferably by a plated hole 230 formed through the substrate 200, to another runner (not shown) formed on the opposite surface of the substrate 200. In like manner, the outer end 235 of the second runner 210 is also coupled to another runner (not shown) formed on the opposite surface of the substrate 200. This coupling is preferably achieved by drilling a hole 240 through the substrate 200 and thereafter plating the hole 240 to provide an electrical coupling. At the inner end 245, the second runner 210 is preferably coupled to a ground voltage. The second runner 210 can be, for example, coupled to ground by a printed circuit runner, a plated hole terminating in a ground plane, a conductor soldered between ground and a ground terminal formed on the inner end 245 of the second runner 210, or any combination of the above.

Figure 3:
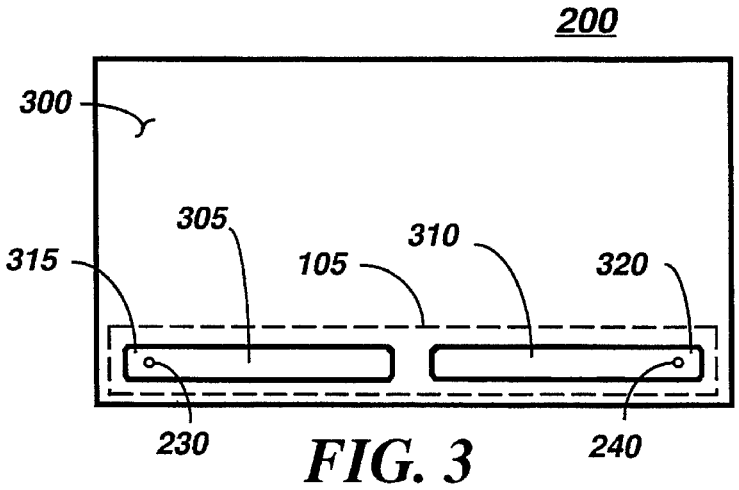
FIG. 3 is an orthographic view of a second surface of the substrate and circuitry, including the antenna, of FIG. 2 in accordance with the preferred embodiment of the present invention.

Referring next to FIG. 3, an orthographic view of a second surface 300, opposite the first surface 215 (FIG. 2), of the substrate 200 is shown. In accordance with the present invention, third and fourth elongated runners 305, 310 are plated, using conventional techniques, on the second surface 300 of the substrate 200 beneath the first and second runners 205, 210 (FIG. 2). The third and fourth runners 305, 310, similar to the runners 205, 210, preferably are formed from copper or another conductive material. At an outer end 315, the third runner 305 is coupled, as described above, to the first runner 205 located opposite and parallel to the third runner 305. Likewise, the fourth runner 310 is coupled, at an outer end 320, to the second runner 210 located opposite and parallel thereto. The electrical coupling is preferably accomplished by plated holes 230, 235 formed through the substrate 200 at the outer ends 225, 235, 315, 320 of the runners 205, 210, 305, 310. The size, i.e., length and width, of the two runners 305, 310 is dependent upon the thickness of the copper plating, the frequency at which the RF signals are received, and characteristics of the substrate 200, as mentioned above.

The first and third runners 205, 305, which are electrically coupled, and the second and fourth runners 210, 310, which are also electrically coupled, each form monopole elements of the dipole antenna 105. It will be appreciated that the monopole elements are coupled to each other only through the receiving circuitry 110 and ground and therefore have no direct electrical connection. More specifically, the first runner 205 is coupled only to the third runner 305 and to the receiving circuitry 110 at the input of the receiver 115 (FIG. 1). The third runner 305 is coupled only to the first runner 205. The second runner 210 is coupled only to ground and to the fourth runner 310. The fourth runner 310 is coupled only to the second runner 310.

Figure 4:
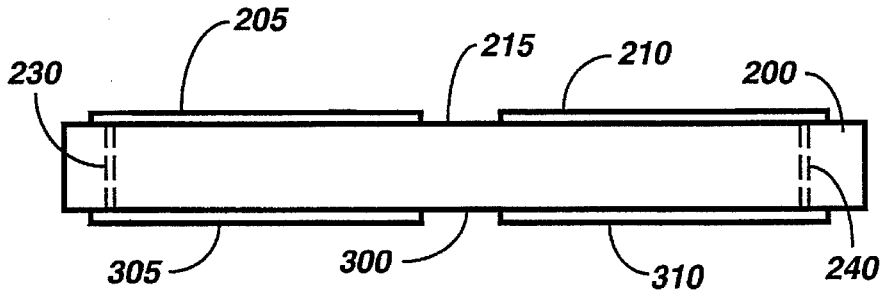
FIG. 4 is a side view of the substrate and the antenna of FIG. 2 in accordance with the preferred embodiment of the present invention.

FIG. 4 is a side view of the substrate 200 in accordance with the present invention. As shown, each of the four runners 205, 210, 305, 310 are plated onto the substrate 200 with a thickness determined by the employed plating equipment. The first and third runners 205, 305 and the second and fourth runners 210, 310 are approximately aligned with each other on the opposite surfaces 215, 300 of the substrate 200 such that the plated holes 230, 240 couple the appropriate runners at their ends. It will be recognized, however, that small variations in the size and placement of the runners due to design and manufacturing tolerances usually do not render the overall performance of the dipole antenna 105 (FIG. 1) unacceptable.

As shown in FIGS. 2–4, the dipole antenna 105 is advantageously etched directly onto a substrate 200 included in the radio receiver 100. Therefore, implementation of the antenna 105 introduces no additional parts into the design and manufacture of the radio receiver 100, and the antenna 105 requires no additional space within the radio receiver 100 other than that already allocated for use by the substrate 200 and the receiver circuitry 110 mounted thereon. As a result, the antenna 105 may be very useful for applications, such as paging applications, in which the available space within an electronic device is limited. Furthermore, because the antenna 105 is formed directly on the substrate 200, the antenna 105 is not subject to ordering, stocking, and assembly errors which normally accompany the introduction of a separate element into an electronic device.

Preferably, the dipole antenna 105 is a half-wave dipole antenna comprising two quarter-wave monopole elements formed from the first and third runners 205, 305 and the second and fourth runners 210, 310. Therefore, the sizes of the runners 205, 210, 305, 310 can be determined by performing calculations based upon the following formulas:

$$\epsilon_{eff}=\frac{\epsilon_r+1}{2}+\frac{\epsilon_r-1}{2}\left[\left(1+\frac{12h}{w}\right)^{-1/2}+0.04\left(1-\frac{w}{h}\right)^{2}\right] \quad (1)$$

and $$\lambda=\frac{c}{f\sqrt{\epsilon_{eff}}}\ . \quad (2)$$

Regarding formula (1), h is the thickness of the substrate 200 between the plated runners 205, 210, 305, 310, $\omega$ is the width of the runners 205, 210, 305, 310, $\epsilon_r$ is the dielectric constant of the substrate 200, and $\epsilon_{eff}$ is the effective dielectric constant of the substrate 200 with the runners 205, 210, 305, 310 plated thereon. Regarding formula (2), c is the speed of light, f is the frequency at which the RF signals are received, and $\lambda$ is the wavelength in centimeters.

By way of example, conventional measurement techniques can be employed to determine that the dielectric constant $\epsilon_r$ of a printed circuit board manufactured from an FR-4 (flame retardant classification) epoxy glass material is approximately equal to two, i.e., $\epsilon_r$=2, at a frequency of nine-hundred-thirty (930) megahertz. Using formula (1), when the thickness h of the printed circuit board is approximately 0.08 centimeters and the width $\omega$ of runners forming an antenna is approximately 0.08 centimeters, the effective dielectric constant is calculated to be approximately 1.64, i.e., $\epsilon_{eff}$=1.64. Next, using formula (2) for a frequency of 930 megahertz, the wavelength $\lambda$ is calculated to be 25.189 centimeters. One of ordinary skill in the art will recognize that the length of each monopole element forming a dipole antenna is given by the following formula:

$$l_m=\frac{\lambda}{4}\ , \quad (3)$$

wherein $l_m$ is the length of each monopole element. Using formula (3), it can be shown that, for the above example, the length of each monopole element is approximately 6.30 centimeters. One configuration, therefore, for forming a printed circuit board dipole antenna comprises four runners of equal lengths, wherein the length of each runner is approximately 3.15 centimeters. It will be appreciated, however, that other configurations, in which the runners are not of equal lengths, are possible as well. Additionally, other substrate configurations can be used without departing from the teachings herein. For example, a printed circuit dipole antenna could be formed on inner, as well as outer, layers of a printed circuit board.

Figure 5:
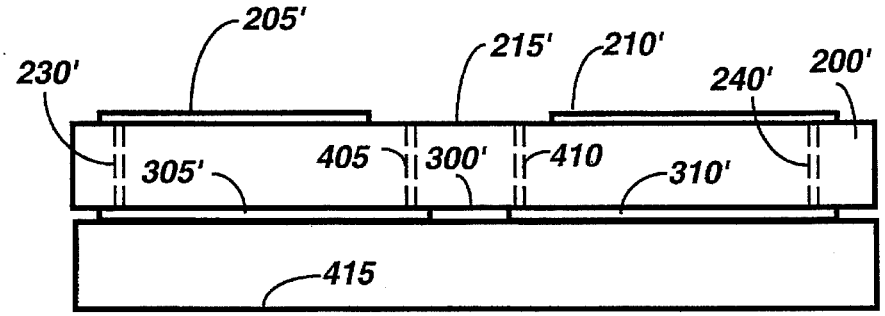
FIG. 5 is a side view of a substrate on which an antenna is plated in accordance with an alternate embodiment of the present invention.

FIG. 5 is a side view of a dipole antenna plated onto a substrate 200' in accordance with an alternate embodiment of the present invention. Similar to the dipole antenna 105 (FIG. 2), the dipole antenna according to this alternate embodiment comprises first and second elongated runners 205', 210' plated on a first surface 215' of the substrate 200' and third and fourth elongated runners 305', 310' plated onto a second surface 300' of the substrate 200' beneath the first and second elongated runners 205', 210'. As in the above-described embodiment, the first and third runners 205', 305' are coupled by the plated hole 230', and the second and fourth runners 210', 310' are coupled by the plated hole 240'. However, the third runner 305', rather than the first runner 205', is coupled to receiving circuitry (not shown) mounted on the first surface 215' of the substrate 200' by a plated hole 400 formed through the substrate 200'. Also, the fourth runner 310', rather than the second runner 210', is coupled to ground by a plated hole 410 formed through the substrate 200'. This configuration is advantageous for situations in which one or more additional substrates 415 are used to form a multi-layer printed circuit board, and the third and fourth runners 305', 310' are formed on an inner layer, as shown. Using this configuration, the first and second runners 205', 210', which are formed on an outer layer, are accessible and can be laser-trimmed to ensure precision performance of the dipole antenna.

In still a further alternate embodiment of the present invention, a monopole antenna, rather than a dipole antenna, can be plated onto a substrate to provide RF signals to receiving circuitry. A monopole antenna according to this alternate embodiment can simply comprise, for instance, the first and third elongated runners 205', 305' of FIG. 5 coupled by the plated hole 230', wherein the third runner 305' is coupled to the receiving circuitry, and the first runner 205' is connected only to the third runner 305'. The second and fourth runners 210', 310' are not necessary for formation of the monopole antenna.

Figure 6:
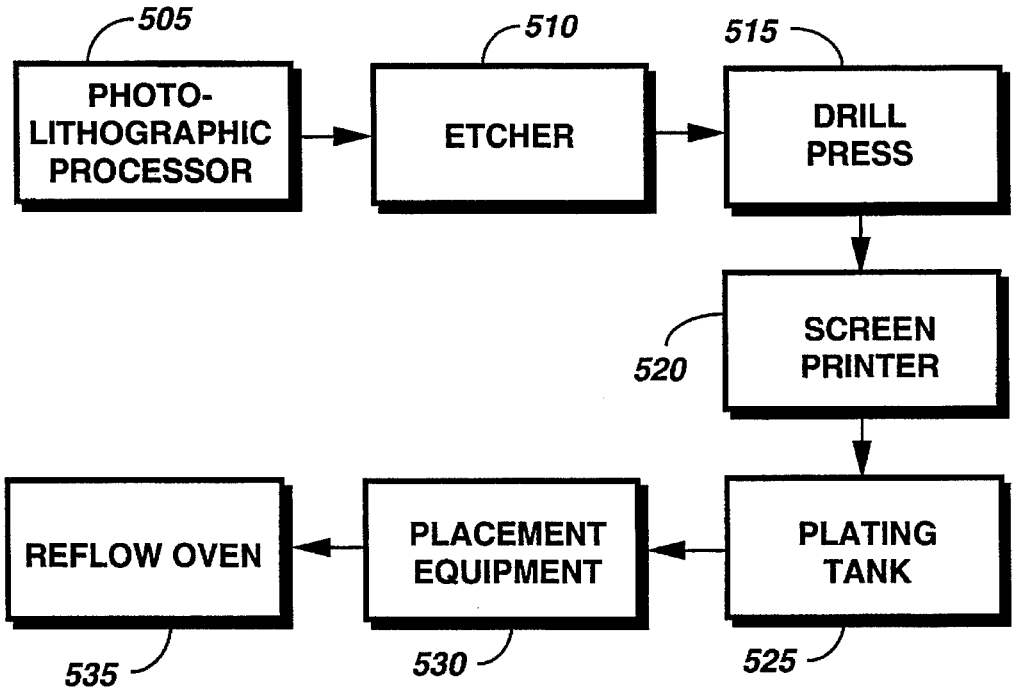
FIG. 6 is a process flow diagram illustrating a process which can be used for manufacturing the antenna of FIG. 2 in accordance with the present invention.

Referring next to FIG. 6, a process flow diagram depicts a manufacturing process for constructing the dipole antenna 105 (FIGS. 2–4). The initial step in the construction process involves imprinting a photographic image of the runners 205, 210, 305, 310 onto the substrate 200 by use of a device such as a photolithographic processor 505. At this time, images of other printed circuitry can also be imprinted onto the substrate 200. Next, the imprinted substrate 200 is preferably processed by etching equipment 510 to etch metallization onto the substrate 200 as indicated by the printing thereon. This process selectively deposits metallization onto the substrate 200 to form the runners 205, 210, 305, 310 and other printed circuitry. Subsequently, a drill press 515 is employed to drill holes, such as the holes 230, 240 (FIG. 4), through the substrate 200 in designated locations, after which a screen printer 520 selectively laminates the substrate 200 to apply a non-conductive material, such as photo-resist, thereon. During this process, metallized areas, for example, component pads upon which components are to be placed, are not laminated. Additionally, drilled holes remain exposed. The exposed metallized areas of the substrate 200 are thereafter plated with a conductive material in a plating tank 525. In this manner, metallized surfaces, such as the runners 205, 210, 305, 310, can be electrically coupled by drilled holes, such as the holes 230, 240.

When the receiving circuitry 110 is to be mounted on the substrate 200 in an automated process, the substrate 200 is next processed by placement equipment 530 for automatically placing receiving components on the appropriate component pads, which have been exposed to the plating. A reflow oven 535 is then employed to apply heat to the substrate 200 to reflow the metallization between the receiver components and the component pads, thereby securing the receiving circuitry 110 to the substrate 200.

In summary, the dipole antenna as described above comprises four runners etched directly onto a printed circuit board. Two of the runners are located on a first surface of the printed circuit board and are coupled respectively, to the receiving circuitry and to ground. Two more runners are located on the opposite surface of the printed circuit board parallel to and beneath the first two runners. Each pair of runners on opposite surfaces of the printed circuit board is electrically coupled by plated holes formed through the printed circuit board such that the runners function as an RF antenna. In this manner, the antenna is conveniently constructed on an existing component, i.e., the printed circuit board, such that no additional parts are required. As a result, ordering, stocking, and assembly errors associated with the use of separate parts are avoided, thereby saving time and cost for a radio receiver using the antenna according to the present invention.

Furthermore, the antenna consumes only minimal space within the radio receiver. More specifically, the antenna requires only a small region of the existing printed circuit board for implementation. Therefore, the antenna is ideal for use in radio receivers, such as paging receivers, which typically have very tight space constraints.

It will be appreciated by now that there has been provided an RF antenna which can be accommodated in a limited amount of space without introducing additional parts into the design of a radio receiver housing the antenna.

What is claimed is:

1. A radio receiver for receiving radio frequency (RF) signals, the radio receiver comprising:

an insulative substrate on which receiving circuitry for recovering information included in the RF signals is mounted; and a dipole antenna for receiving the RF signals, comprising:

a first elongated member plated on a first surface of the insulative substrate along a single axis and coupled to the receiving circuitry for providing the RF signals thereto;

a second elongated member plated on a second surface of the insulative substrate opposite the first and surface, the second elongated member formed approximately parallel to and beneath the first elongated member and coupled thereto by a plated hole formed through the insulative substrate at outer regions of the first and second elongated members, thereby forming a first monopole element;

a third elongated member plated on the first surface of the insulative substrate along the single axis and coupled to a ground terminal on the first surface of the substrate for receiving a ground voltage; and a fourth elongated member plated on the second surface of the insulative substrate and formed approximately parallel to and beneath the third elongated member and coupled to the third elongated member, thereby forming a second monopole element.

2. The radio receiver according to claim 1, wherein the insulative substrate has a plated hole formed therethrough for electrically coupling the third and fourth elongated members at outer regions of the third and fourth elongated members.

3. The radio receiver according to claim 2, wherein the third elongated member is coupled to the ground voltage at an inner region of the third elongated member, wherein the inner region of the third elongated member is located opposite the outer region of the third elongated member.

4. The radio receiver according to claim 1, wherein the first elongated member is coupled to the receiving circuitry at an inner region of the first elongated member, wherein the inner region of the first elongated member is located opposite the outer region of the first elongated member.

5. The radio receiver according to claim 1, wherein the first elongated member is directly connected to the receiving circuitry without intervening frequency compensating members or impedance transforming elements.

6. The radio receiver according to claim 1, wherein the third elongated member is directly connected to the ground voltage without intervening frequency compensating members or impedance transforming elements.

7. The radio receiver according to claim 1, wherein widths of the first, second, third, and fourth elongated members are substantially uniform along the lengths of said elongated members such that the width of each elongated member at the outer region of each elongated member is substantially equivalent to the width of each elongated member at the inner region of each elongated member.

8. The radio receiver according to claim 7, wherein the lengths of the first, second, third, and fourth elongated members are dependent upon a frequency at which the RF signals are received, a dielectric constant of the insulative substrate, and a thickness of the insulative substrate.

9. The radio receiver according to claim 8, wherein, when the RF signals are received at a frequency of 930 megahertz and the dielectric constant of the insulative substrate is approximately equal to two, the first and second monopole elements are each approximately 6.30 centimeters long and approximately 0.08 centimeters wide.

10. A radio receiver for receiving radio frequency (RF) signals, the radio receiver comprising:

a printed circuit board on which receiving circuitry for recovering information included in the RF signals is mounted; and a dipole antenna for receiving the RF signals, comprising:

first and second elongated runners, each having inner and outer regions, plated on a first surface of the printed circuit board along a single axis;

third and fourth elongated runners, each having inner and outer regions, plated on a second surface of the printed circuit board opposite the first surface, the third and fourth elongated runners formed approximately parallel to and beneath the first and second elongated runners, respectively;

wherein the inner region of the first elongated runner is electrically coupled to the receiving circuitry for providing the RF signals thereto, and wherein the outer region of the first elongated runner is further electrically coupled to the outer region of the third elongated runner by a first plated hole formed through the printed circuit board, thereby forming a first monopole element of the dipole antenna; and wherein the inner region of the second elongated runner is coupled to a ground terminal for receiving a ground voltage, and wherein the outer region of the second elongated runner is further electrically coupled to the outer region of the fourth elongated runner by a second plated hole formed through the printed circuit board, thereby forming a second monopole element of the dipole antenna.

11. The radio receiver according to claim 10, wherein the inner region of the first elongated runner is directly connected to the receiving circuitry without intervening frequency compensating members or impedance transforming elements.

12. The radio receiver according to claim 10, wherein the inner region of the second elongated runner is directly connected to the ground voltage without intervening frequency compensating members of impedance transforming elements.

13. The radio receiver according to claim 10, wherein lengths of the first, second, third, and fourth elongated runners are dependent upon a frequency at which the RF signals are received, a dielectric constant of the printed circuit board, and a thickness of the printed circuit board.

14. The radio receiver according to claim 13, wherein, the RF signals are received at a frequency of 930 megahertz and the dielectric constant of the printed circuit board is approximately equal to two, the first and second monopole elements are each approximately 6.30 centimeters long and approximately 0.08 centimeters wide.

15. The radio receiver according to claim 10, wherein the width of each of the first, second, third, and fourth elongated runners substantially uniform along its length.

* * * * *